US007631425B2

(12) United States Patent
Kamiji et al.

(10) Patent No.: US 7,631,425 B2
(45) Date of Patent: Dec. 15, 2009

(54) METHOD FOR MANUFACTURING ROCKER ARM

(75) Inventors: Michiyuki Kamiji, Osaka (JP); Yoshio Kawatake, Osaka (JP)

(73) Assignee: Nakanishi Metal Works Co., Ltd., Osaka-Shi (JP)

( * ) Notice: Subject to any disclaimer, the term of this patent is extended or adjusted under 35 U.S.C. 154(b) by 447 days.

(21) Appl. No.: 11/300,654

(22) Filed: Dec. 15, 2005

(65) Prior Publication Data

US 2006/0143912 A1 Jul. 6, 2006

(30) Foreign Application Priority Data

Dec. 17, 2004 (JP) ..... 2004-366359
Dec. 17, 2004 (JP) ..... 2004-366376

(51) Int. Cl.
*B21K 1/12* (2006.01)

(52) U.S. Cl. ..... 29/888.2; 123/90.39; 123/90.41

(58) Field of Classification Search ..... 29/509, 29/888.2; 72/315; 123/90.39, 90.41
See application file for complete search history.

(56) References Cited

U.S. PATENT DOCUMENTS

| | | | | |
|---|---|---|---|---|
| 4,430,783 | A * | 2/1984 | Wherry | 29/888.2 |
| 5,887,474 | A * | 3/1999 | Cutshall et al. | 72/315 |
| 6,199,527 | B1 * | 3/2001 | Okubo et al. | 123/90.41 |
| 6,918,170 | B2 * | 7/2005 | Luthi | 29/509 |
| 7,222,599 | B2 * | 5/2007 | Waseda | 123/90.39 |

(Continued)

FOREIGN PATENT DOCUMENTS

JP 58-187221 11/1983

(Continued)

OTHER PUBLICATIONS

Machine Translation of JP11210418, Mar. 8, 1999.*

(Continued)

*Primary Examiner*—David P Bryant
*Assistant Examiner*—Ryan J Walters
(74) *Attorney, Agent, or Firm*—Kratz, Quintos & Hanson, LLP

(57) ABSTRACT

A method for manufacturing according to the present invention includes a step of obtaining a bent workpiece 13 with prepared apertures 21 and 21, wherein the bent work piece 13 includes a pair of side walls 20 and 20 disposed in parallel with each other and connecting walls 30 and 40 for connecting the side walls 20 and 20, the pair of side walls 20 an d20 each having a prepared aperture 21, and a step of forming a roller supporting shaft fixing aperture 25 by inserting a sizing punch 60 into the prepared aperture 21, wherein the sizing punch 60 has a tapered push enlarging portion 61 at a tip end portion, a basal end side of the push enlarging portion being larger than the prepared aperture 21 in diameter, and a tip end side of the push enlarging portion 61 being smaller than the prepared aperture 21 in diameter, whereby the push enlarging portion 61 causes plastic flow of an inner peripheral portion of the prepared aperture to finish the inner peripheral surface of the prepared aperture to thereby obtain a roller supporting shaft fixing aperture 25. By this structure, sufficient shaft holding ability can be given to the roller supporting shaft fixing aperture, and a rocker arm can be manufactured at low costs.

4 Claims, 8 Drawing Sheets

U.S. PATENT DOCUMENTS

2004/0134065 A1 * 7/2004 Kadokawa et al. ..... 29/888.2

FOREIGN PATENT DOCUMENTS

| | | |
|---|---|---|
| JP | 1-91931 | 4/1989 |
| JP | 3497368 | 11/2003 |
| JP | 2004-176557 | 6/2004 |
| JP | 3582977 | 8/2004 |

OTHER PUBLICATIONS

Machine Translation of JP2004-176557.*
Japanese Office Action w/ English Translation dated Dec. 16, 2008.
Japanese Office Action dated Apr. 14, 2009 with English Translation.

* cited by examiner

METHOD FOR MANUFACTURING ROCKER ARM

This application claims priority to Japanese Patent Application Nos. 2004-366359 filed on Dec. 17, 2004 and 2004-366376 filed on Dec. 17, 2004, the entire disclosures of which are incorporated herein by reference in their entireties.

BACKGROUND OF THE INVENTION

1. Field of the Invention

The present invention relates to a method for manufacturing a rocker arm for opening and closing a valve in a valve operating system for use in an internal combustion engine for vehicles for example.

2. Description of the Related Art

The following description sets forth the inventor's knowledge of related art and problems therein and should not be construed as an admission of knowledge in the prior art.

FIG. 10 is a cross-sectional view showing a valve operating system for use in an internal combustion engine for vehicles. As shown in this figure, provided in this valve operating system is a rocker arm 1 for converting a rotary motion of a cam 3 which rotates in conjunction with a crankshaft 2 into a reciprocating motion of a valve stem 5 for a valve such as an intake valve or an exhaust valve.

As shown in FIGS. 10 and 11, this rocker arm 1 is provided with a pair of side walls 1*a* and 1*a* disposed in parallel with each other, connecting walls 1*b* and 1*c* connecting one end of the side walls and the other end thereof respectively, a valve stem contacting portion 1*d* which is attached to the one end side wall 1*b* and is to be brought into contact with the valve stem 5, and a pivot engaging portion 1*e* which is attached to the other end side wall 1*c* and is to be engaged with a pivot portion 6 fixed to a cylinder head. Both the side walls 1*a* and 1*a* of this rocker arm 1 are provided with shaft fixing apertures 1*f* and 1*f* on the same axis line into which a supporting shaft 8 of a roller 7 is fixedly inserted, so that the roller 7 and the cam 3 are brought into a rolling contact with each other.

This kind of rocker arm has been conventionally manufactured by forging or precision casting (lost-wax processing). However, in accordance with the recent year's movement toward high revolution and high power of an internal combustion engine, it is required to attain lightweighting of a rocker arm to reduce the inertia-weight, and therefore there are a number of proposals on press working techniques for manufacturing a rocker arm.

In a method for manufacturing a rocker arm by press working, as a method for forming a shaft fixing aperture 1*f*, cutting using a drill or press blanking using a punch is generally employed.

However, cutting work causes deteriorated production efficiency and an increased production cost due to the lower efficiency as compared with press working, and also may exert a harmful influence by chips generated during the cutting work.

On the other hand, in a press blanking method, although the production efficiency can be improved, sufficient flatness of the inner peripheral surface of the punched aperture cannot be secured, which makes it difficult to secure, e.g., sufficiently wide sheared surface in the inner peripheral surface. This causes a difficulty in assuredly bringing the inner peripheral surface into contact with the supporting shaft 8, which in turn may cause deteriorated shaft holding force.

Under the circumstances, the assignee of the present invention has developed a method for forming a shaft fixing aperture 1*f* as disclosed by Japanese Patent No. 3,497,368 (hereinafter referred to as "Patent Document 1") and Japanese Patent No. 3,582,977(hereinafter referred to as "Patent Document 2"). In the method, a prepared aperture is initially formed by blanking, and then a shaving punch is driven into the prepared aperture to thereby obtain a smoothed inner peripheral surface of the aperture.

With this method, high productivity can be attained since the shaft fixing aperture 1*f* is formed only by press working using an aperture forming punch and a shaving punch, and a smoothed inner peripheral surface of the aperture by shaving can be obtained, resulting in sufficient shaft holding ability.

In the method for manufacturing a rocker arm disclosed by the aforementioned Patent Documents 1 and 2, a shaving punch used as a tool having a sharp cutting edge is used. However, a large load is intensively applied to the cutting edge during the processing, which causes an early abrasion of the cutting edge. Using such punch with an abraded cutting edge deteriorates the cutting workability, causing generation of burrs, which in turn causes deteriorated quality. As will be understood from the above, a shaving punch is short in life, and therefore it is required to replace with a new one in a short period of time. Thus, the method should be improved in terms of running costs.

Furthermore, in the method as disclosed in Patent Documents 1 and 2, since an inner peripheral portion of the prepared aperture is shaved off by shaving, chips will be generated, which in turn cause defects such as littering of chips and/or damages due to the chips. Accordingly, it is also required to take sufficient measures to remove such chips.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a method for efficiently manufacturing a rocker arm with a shaft fixing aperture having sufficient shaft holding ability at row costs without generating any chips.

According to a first aspect of a preferred embodiment of the present invention, a method for manufacturing a rocker arm, comprising the steps of:

obtaining a bent workpiece with prepared apertures, wherein the bent work piece includes a pair of side walls disposed in parallel with each other, and connecting wallsfor connecting the side walls, the pair of side walls each having a prepared aperture; and forming a roller supporting shaft fixing aperture by inserting a sizing punch into the prepared aperture, wherein the sizing punch has a tapered push enlarging portion at a tip end portion, a basal end side of the push enlarging portion being larger than the prepared aperture in diameter, and a tip end side of the push enlarging portion being smaller than the prepared aperture in diameter, whereby the push enlarging portion causes plastic flow of an inner peripheral portion of the prepared aperture to finish the inner peripheral surface of the prepared aperture to thereby obtain a roller supporting shaft fixing aperture.

According to a second aspect of a preferred embodiment of the present invention, the method for manufacturing a rocker arm as recited in claim 1, wherein an external peripheral surface of the push enlarging portion of the sizing punch is formed as a tapered working surface, and wherein an angle of inclination with respect to an axis of the working surface is set to 10 to 50°.

According to a third aspect of a preferred embodiment of the present invention, a method for manufacturing a rocker arm, comprising the steps of:

obtaining a flat workpiece with prepared apertures to be formed into roller supporting shaft fixing apertures;

obtaining a bent workpiece with prepared apertures by bending the flat workpiece with prepared apertures, the bent work piece including a pair of side walls disposed in parallel with each other, and a connecting wall for connecting the side walls, the pair of side walls each having a prepared aperture; and forming a roller supporting shaft fixing aperture by inserting a sizing punch into the prepared aperture, wherein the sizing punch has a tapered push enlarging portion at a tip end portion, a basal end side of the push enlarging portion being larger than the prepared aperture in diameter, and a tip end side of the push enlarging portion being smaller than the prepared aperture in diameter, whereby the push enlarging portion causes plastic flow of an inner peripheral portion of the prepared aperture to finish the inner peripheral surface of the prepared aperture to thereby obtain a roller supporting shaft fixing aperture.

According to a fourth aspect of a preferred embodiment of the present invention, the method for manufacturing a rocker arm as recited in claim 1, wherein the step of forming the roller supporting shaft fixing aperture includes:

disposing the sizing punches at the outsides of both the side walls of the bent workpiece with the prepared apertures so as to oppose each other with the punches aligned each other;

simultaneously inserting both the sizing punches into the prepared apertures of the side walls to simultaneously finish the prepared apertures.

According to the method for manufacturing a rocker arm of the invention as recited in the aforementioned Item [1], since the rocker arm can be manufacture only by press working such as blanking, bending and sizing, high productivity can be attained and smooth finishing of the inner peripheral surface of the aperture can be attained by the sizing. Also, sufficient shaft supporting ability can be secured.

Furthermore, since the sizing punch is inserted into the prepared aperture to cause plastic flow of the inner peripheral portion of the prepared aperture to thereby finish the inner peripheral surface of the prepared aperture, in contract to a method in which a shaving punch is inserted, a load to be applied to the punch can be decreased, and it becomes possible to prevent early abrasion/wear of the punch. Furthermore, the burden of maintenance work can be reduced, resulting in reduced running costs.

Furthermore, since this method causes plastic flow of the inner peripheral surface portion of the prepared aperture, it is possible to assuredly prevent generation of chips or the like during the processing. Accordingly, defects such as generation of scratches due to adhesion of chips or the like and/or generating/scattering of chips or the like can be prevented assuredly.

At the time of, e.g., bending the blank workpiece 12 after forming the prepared apertures, even if the central axes L of both the prepared apertures 21 may sometimes be aligned, the penetrations of the sizing punches from both sides will correct the central axes of the apertures simultaneously with finishing of the prepared apertures. Thus, high positional accuracy can be maintained.

According to the method for manufacturing a rocker arm of the invention as recited in the aforementioned Item [2], the plastic flow of the inner peripheral portion of the prepared aperture can be performed more smoothly, and the aforementioned effects can be secured more assuredly.

According to the method for manufacturing a rocker arm of the invention as recited in the aforementioned Item [3], since the rocker arm can be manufacture only by press working such as blanking, bending and sizing, high productivity can be attained and smooth finishing of the inner peripheral surface of the aperture can be attained by the sizing. Also, sufficient shaft supporting ability can be secured.

In the present invention, since the processing for forming the prepared aperture is executed against a flat blank workpiece, the removing processing for the punched portions can be performed by normal press operations without requiring special operations. Furthermore, the insertion of the sizing punch into the prepared aperture causes plastic flow of the prepared aperture to thereby finish the aperture, and therefore generation of chips can be prevented. As mentioned above, in the aperture opening processing and/or the prepared aperture finishing processing, no special operation for removing chips is required, resulting in smooth processing, which in turn can improve the productivity. Especially, in the present invention, no special operation will be required in any steps including the step of forming apertures and finishing them, and the method can be performed by normal press working. Therefore, it enables an employment of a transfer press machine executing all of press working continuously, which in turn can attain automation of a sequence of press working from blanking to finishing. This improves the productivity dramatically.

Furthermore, since the sizing punch is inserted into the prepared aperture to cause plastic flow of the inner peripheral portion of the prepared aperture to thereby finish the inner peripheral surface of the prepared aperture, in contract to a method in which a shaving punch is inserted, a load to be applied to the punch can be decreased, and it becomes possible to prevent early abrasion/wear of the punch. Furthermore, the burden of maintenance work can be reduced, resulting in reduced running costs.

Furthermore, at the time of finishing the prepared aperture, no chip or the like generates, and therefore defects such as generation of scratches due to adhesion of chips or the like and/or generating/scattering of chips or the like can be prevented assuredly.

In the present invention, when the flat workpiece is bent after forming the prepared apertures, the positional misalignment of the prepared apertures may occur. However, even if such positional misalignment occurs, the insertion of the sizing punch in the prepared apertures can simultaneously correct the aperture positions simultaneously with the aperture finishing, resulting in high positional accuracy.

According to the method for manufacturing a rocker arm of the invention as recited in the aforementioned Item [4], the positional misalignment between the prepared apertures can be corrected, and therefore the phase difference can be eliminated to further improve the positional accuracy of the prepared apertures. Furthermore, since the pressures for inserting the sizing punches can be applied evenly in a balanced manner from both sides of the bent workpiece, it is possible to assuredly prevent generation of harmful deformation due to the punch inserting pressures, which in turn makes it possible to maintain high quality.

<Related Inventions>

In the present invention, the following structures can be employed.

[5] The method for manufacturing a rocker arm as recited in the aforementioned Item [1] or [2], wherein the step of obtaining the bent workpiece with the prepared apertures is performed by forming a flat blank workpiece having the prepared apertures by punching and then bending the flat blank workpiece.

[6] The method for manufacturing a rocker arm as recited in the aforementioned Item [1] or [2], wherein the step of obtaining the bent workpiece with the prepared apertures is performed by bending a flat blank workpiece and then forming the prepared apertures in the side walls of the bent blank workpiece by punching.

[7] The method for manufacturing a rocker arm as recited in the aforementioned Item [6], wherein the step of forming the prepared apertures is performed by disposing aperture opening punches for forming the prepared apertures so as to oppose with each other at the outsides of the side walls of the bent workpiece with the axis aligned each other, and simultaneously advancing both the aperture opening punches from the outsides of the side walls to thereby simultaneously form the prepared apertures in the side walls.

[8] The method for manufacturing a rocker arm as recited in the aforementioned Item [1] or [2], wherein the step of forming the roller supporting shaft fixing aperture is performed by disposing the sizing punches so as to oppose with each other at the outsides of the side walls of the bent workpiece with the axis aligned each other, and simultaneously inserting both the sizing punches into the prepared apertures of the side walls to thereby simultaneously finish the prepared apertures.

[9] The method for manufacturing a rocker arm as recited in the aforementioned Item [1] or [2], wherein the step of forming the roller support shaft fixing aperture is performed by causing plastic flow of the material of the inner peripheral portion of the prepared aperture from a sheared region in the prepared aperture to a fractured region.

[10] A rocker arm manufactured by the manufacturing method as recited in the aforementioned Item [1] or [2].

[11] The rocker arm as recited in the aforementioned Item [10], wherein the inner peripheral surface of the shaft fixing aperture is provided with a flat surface larger than a sheared surface of the prepared aperture.

[12] The method for manufacturing a rocker arm as recited in the aforementioned Item [3] or [4], wherein an external peripheral surface of the push enlarging portion of the sizing punch is formed as a tapered working surface, and wherein an angle of inclination of the working surface with respect to an axis of the sizing punch is set to 10 to 50°.

[13] The method for manufacturing a rocker arm as recited in the aforementioned Item [1] or [2], wherein the step of forming the roller supporting shaft fixing aperture is performed by causing plastic flow of the material of the inner peripheral portion of the prepared aperture from a sheared region in the prepared aperture to a fractured region.

[14] A rocker arm manufactured by the manufacturing method as recited in the aforementioned Item [1] or [2].

[15] The rocker arm as recited in the aforementioned Item [14], wherein the inner peripheral surface of the shaft fixing aperture is provided with a flat surface larger than a sheared surface of the prepared aperture.

According to the method for manufacturing a rocker arm of the invention as recited in the aforementioned Item [5], since the prepared aperture opening processing is executed against the plate workpiece, chip removing processing for removing chips generated by the aperture opening processing can be performed smoothly, which in turn can improve the productivity.

According to the method for manufacturing a rocker arm of the invention as recited in the aforementioned Item [6], the prepared aperture can be formed with a high degree of positional accuracy.

According to the method for manufacturing a rocker arm of the invention as recited in the aforementioned Item [7], since the pressures for inserting the aperture opening punches can be applied evenly in a balanced manner from both sides of the bent workpiece, it is possible to assuredly prevent generation of harmful deformation due to the punch applying pressures, which in turn makes it possible to maintain high quality.

According to the method for manufacturing a rocker arm of the invention as recited in the aforementioned Item [8], the positional misalignment between the prepared apertures can be corrected, and therefore the phase difference can be eliminated to further improve the positional accuracy of the prepared apertures. Furthermore, since the pressures for inserting the sizing punches can be applied evenly in a balanced manner from both sides of the bent workpiece, it is possible to assuredly prevent generation of harmful deformation due to the punch inserting pressures, which in turn makes it possible to maintain high quality.

According to the method for manufacturing a rocker arm of the invention as recited in the aforementioned Item [9], a wider smooth surface can be secured in the inner peripheral surface of the shaft fixing aperture, which further increases the shaft holding ability.

According to the method for manufacturing a rocker arm of the invention as recited in the aforementioned Item [10] and [11], the rocker arm having the aforementioned effects can be provided.

According to the method for manufacturing a rocker arm of the invention as recited in the aforementioned Item [12], the plastic flow of the inner peripheral portion of the prepared aperture can be performed more smoothly, to thereby obtain the aforementioned effects more assuredly.

According to the method for manufacturing a rocker arm of the invention as recited in the aforementioned Item [13], a wider smooth surface can be secured in the inner peripheral surface of the shaft fixing aperture, which further increases the shaft holding ability.

According to the invention as recited in the aforementioned Items [14] and [15], the rocker arm having the aforementioned effects can be provided.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 1A is a perspective view showing a flat blank workpiece, FIG. 1B is a perspective view showing a flat workpiece with prepared apertures, FIG. 1C is a perspective view showing a bent workpiece with prepared apertures, and FIG. 1D is a perspective view showing a rocker arm as a final product;

FIG. 6A is a cross-sectional view showing the state immediately after inserting the sizing punch into the prepared aperture in the production method of the embodiment, FIG. 6B is a cross-sectional view showing the state in which the punch is being inserted into the prepared aperture in the production method of the embodiment, and FIG. 6C is a cross-sectional view showing the state immediately after inserting the sizing punch into the prepared aperture in the production method of the embodiment;

FIGS. 11A and 11B show a conventional rocker arm, wherein FIG. 11A is a cross-sectional view thereof and FIG. 11B is a plan view thereof.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, a method for manufacturing a rocker arm according to an embodiment of the present invention will be explained with reference to drawings.

Figure 1A:
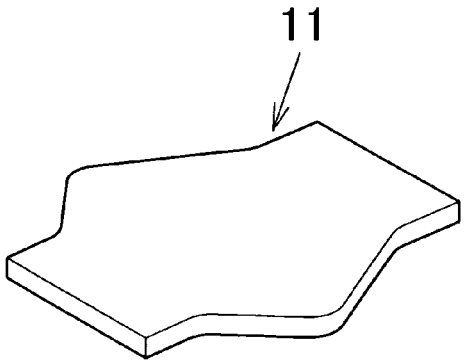
FIGS. 1A to 1D are schematic views each showing a workpiece at each stage of processing in a manufacturing method of a rocker arm according to an embodiment of the present invention.

In this method, as shown in FIG. 1A, predetermined areas of a steel plate as an original plate are punched to obtain a flat blank workpiece 11 with both sides each protruded sideways in an arc-shape.

Figure 1B:
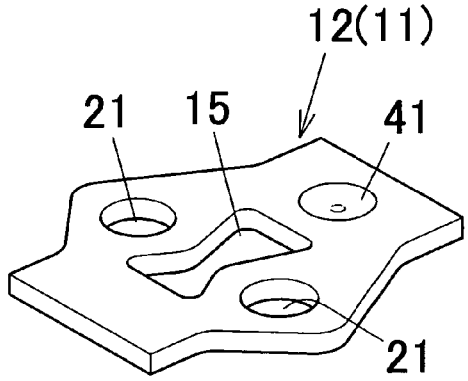

Then, as shown in FIG. 1B, an aperture opening punch is applied to the flat blank workpiece 11 so as to form a central aperture 15 of a drum shape at a central area and prepared apertures 21 and 21 at side areas to thereby obtain a flat blank workpiece 12 with prepared apertures 21 and 21.

Furthermore, the end central portion of the flat blank workpiece 11 is subjected to bulging to form a pivot engaging dented portion 41 of a hemisphere shape.

As to the aforementioned blanking processing for punching out the original plate, the aperture opening processing for forming the central aperture 15, the aperture opening processing for forming the prepared apertures 21 and 21 and the bulging processing for forming the pivot engaging dented portion 41, the sequence of these processing is not specifically limited. For example, all of these processing can be performed simultaneously, or two or more processing can be performed simultaneously, or each processing can be performed one by one.

In the case of forming a chamfer at the peripheral edge of the open end portion of the prepared aperture 21, it is preferable to employ an aperture opening punch having a chamfer forming portion at the external peripheral surface of the basal end portion of the punch so that the chamfer forming portion forms a chamfer by pressing the peripheral edge of the open end portion of the prepared aperture 21 when the punch is driven.

In the present invention, as will be explained later, the aperture forming processing for the prepared aperture 21 can be executed after bending the flat blank workpiece.

Figure 1C:
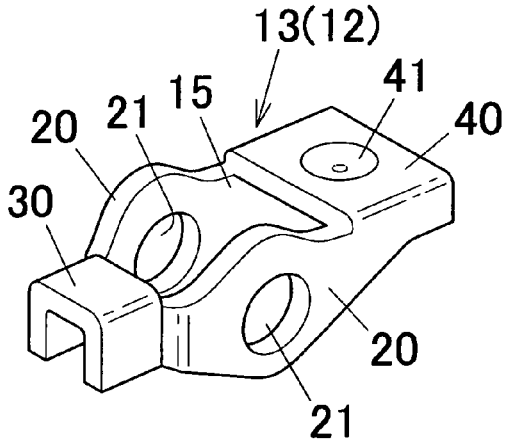
Figure 1D:
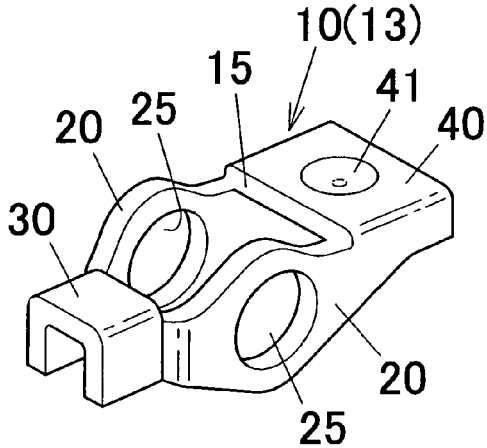

Subsequently, as shown in FIG. 1C, the flat blank workpiece 12 with prepared apertures 21 and 21 is subjected to bending processing to obtain a bent workpiece 13 of a U-shape (inverted U-shape) with prepared apertures 21 and 21.

This bent workpiece 13 is provided with a pair of side walls 20 and 20 disposed in parallel, an one end side connecting wall 30 as a valve stem contacting portion connecting the one end side upper ends of the side walls 20 and 20, and the other end side connecting wall 40 having a pivot engaging dented portion 41 connecting the other end side upper ends of the side walls 20 and 20.

The prepared aperture 21 of each side wall 20 of the obtained bent workpiece 13 is finished with a sizing apparatus 50 which will be detailed later to obtain a roller supporting shaft fixing aperture 25.

Figure 2:
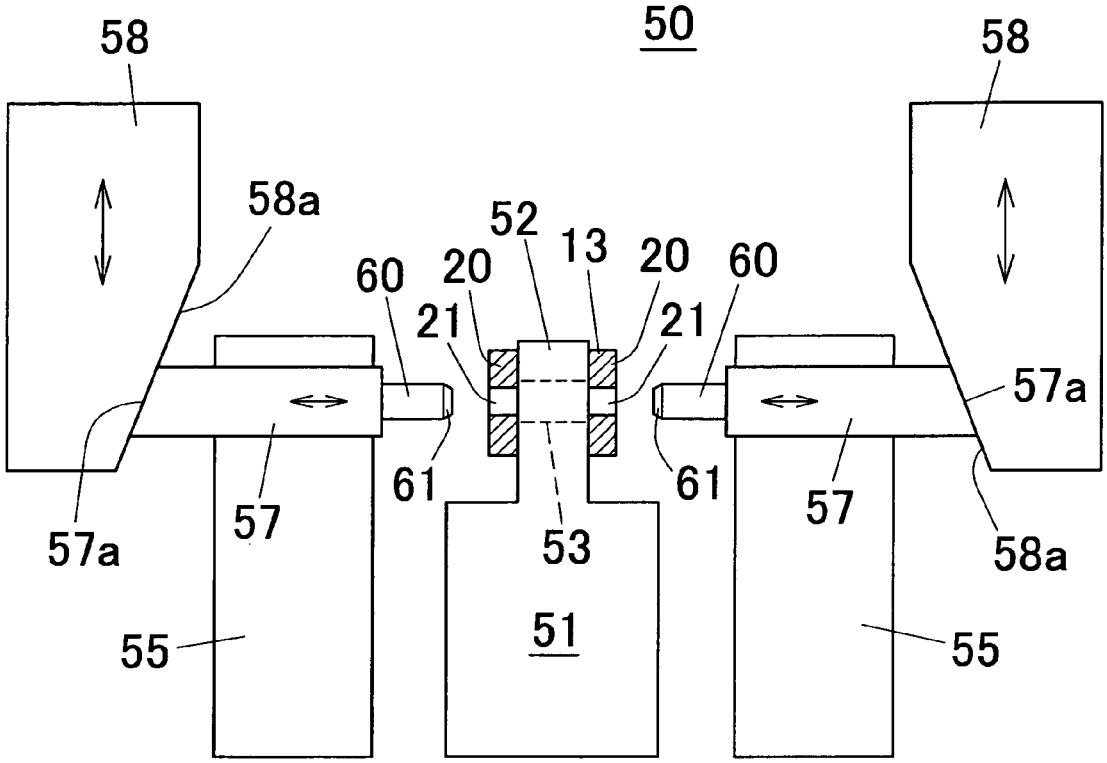
FIG. 2 is a front view showing a sizing apparatus employed in the production method of the embodiment.

As shown in FIG. 2, the sizing apparatus 50 is provided with a base 51. The base 51 has at its upper portion a sizing die 52 with a width corresponding to the space between both side walls 20 and 20 of the bent workpiece 13. This sizing die 52 is configured so that both side walls 20 and 20 of the bent workpiece 13 can be outwardly fitted thereto.

The sizing die 52 has a punch passing aperture 53 extending in the widthwise direction (prepared aperture axial direction) and corresponding to the prepared apertures 21 and 21 formed in the side walls 21 of the bent workpiece 13.

The sizing apparatus 50 further includes punch supporting bases 55 and 55 disposed at both sides of the base 51. Each punch supporting base 55 supports a sizing punch 60 slidable along the axial direction via a punch supporting member 57. Both punches 60 and 60 are disposed such that the axis of each punch coincides with the axis of the punch passing aperture 53 of the sizing die 52.

At both sides of the punch supporting bases 55 and 55, lifting and lowering members 58 are disposed in a state in which the cam surface 58*a* formed at the lower end side of the lifting and lowering member 58 is in slidable contact with the cam surface 57*a* formed at the basal end side of the punch supporting member 57. Thus, when both the lifting and lowering members 58 are lowered, both the sizing punches 60 advance along the axial direction to be inserted in the punch passing aperture 53 of the sizing die 52 from both sides thereof.

Figure 3:
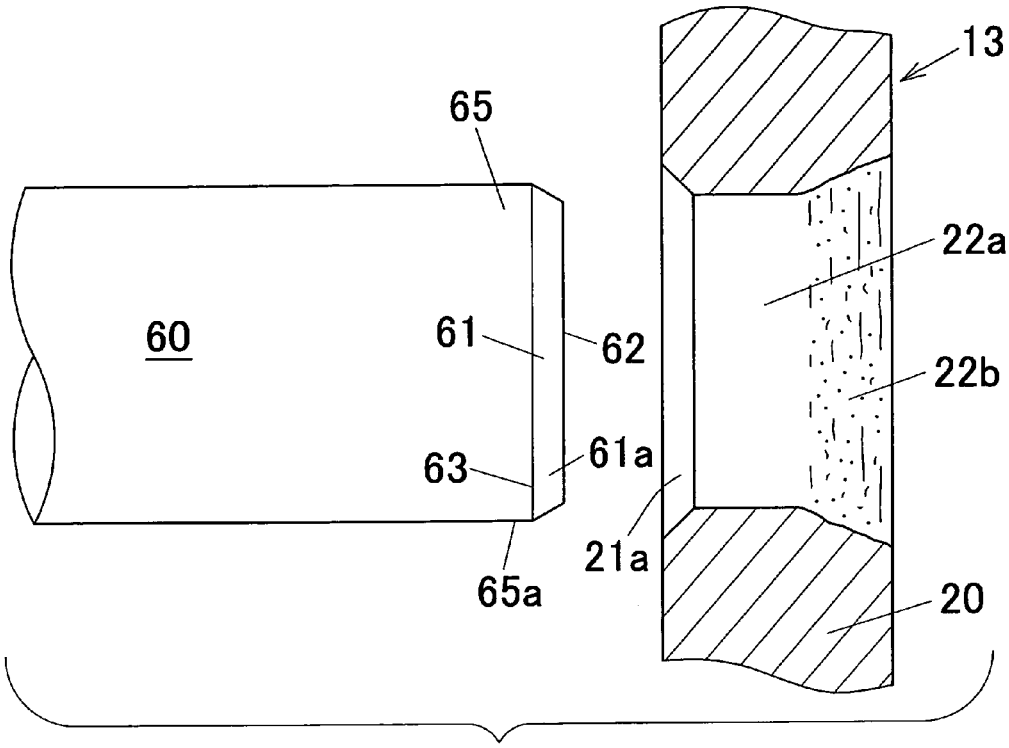
FIG. 3 is a cross-sectional view showing the state immediately before inserting the sizing punch into the prepared aperture in the production method of the embodiment.

Referring to FIG. 3, the sizing punch 60 used in this embodiment has, at its tip end portion, a push enlarging portion 61 tapered down to the tip. In this push enlarging portion 61, the tip 62 is formed to have a diameter smaller than the diameter of the prepared aperture 21 and that the basal end 63 is formed to have a diameter larger than the diameter of the prepared aperture 21. Thus, the external periphery of the push enlarging portion 61 is formed to function as a tapered working surface 61*a*.

The basal end side portion of the punch 60 behind the push enlarging portion 61 is formed as an aperture finishing portion 65 having the same external diameter as an external diameter of a shaft fixing aperture 25 which will be explained later.

The finishing processing of the prepared aperture 21 of the bent workpiece 13 using the aforementioned sizing apparatus 50 can be performed as follows. As explained above, the bent workpiece 13 is mounted on the sizing die 52, and then both the punches 60 and 60 are advanced by simultaneously lowering both the lifting and lowering members 58 and 58. By this, both the punches 60 and 60 run through both the prepared apertures 21 and 21 to finish the inner peripheral surface of each aperture 21, thereby forming a shaft fixing aperture 25.

Figure 5:
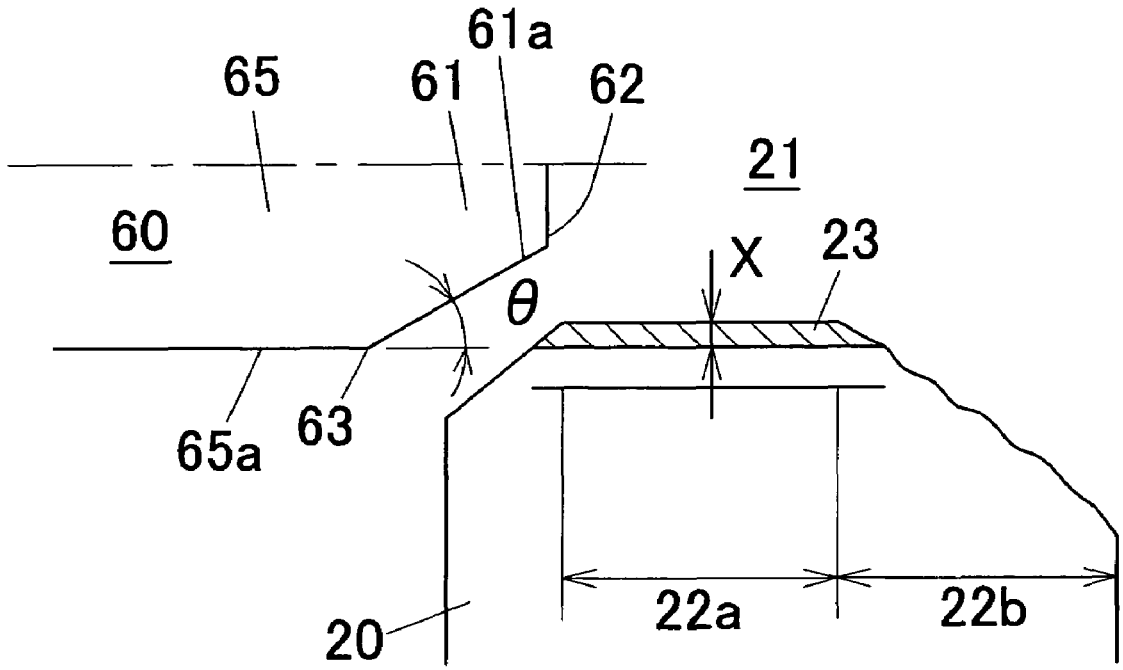
FIG. 5 is a partially enlarged cross-sectional view showing the relationship between the prepared aperture and the sizing punch in the production method of the embodiment.

Now, the behavior of the inner periphery of the prepared aperture 21 when the sizing punch 60 is driven into the prepared aperture 21 will be detailed. Before executing the sizing finish processing of the inner peripheral surface of the prepared aperture 21, as shown in FIGS. 3 and 5, the aperture 21 has a flat and smooth sheared region 22*a* at one side from which the punch 60 is to be inserted and a rough fractured region 22*b* expanding outwardly from the sheared region 22*a* at the other side from which the punch 60 is to be come out. At the opening peripheral edge portion of the prepared aperture 21, a chamfer 21*a* is formed.

Figure 4:
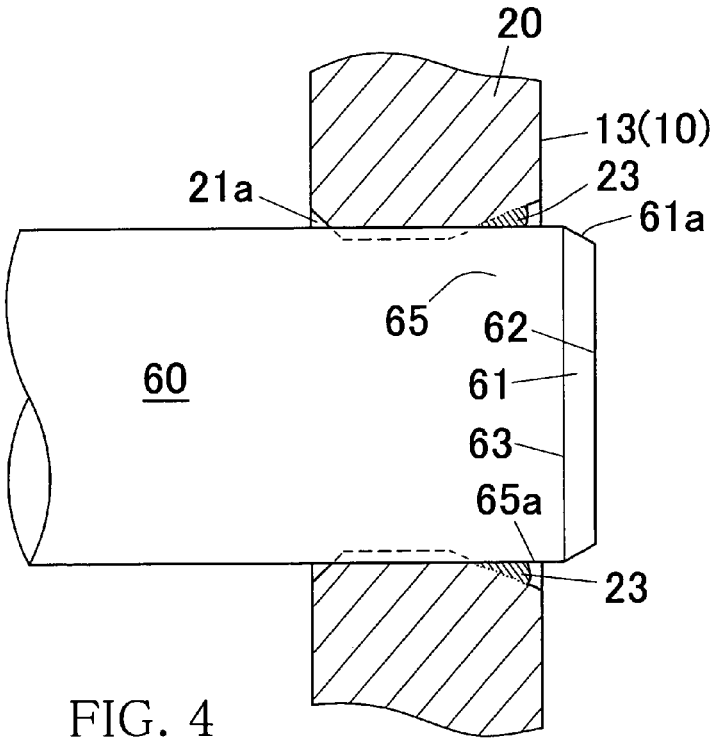
FIG. 4 is a cross-sectional view showing the state immediately after inserting the sizing punch into the prepared aperture in the production method of the embodiment.
Figure 6A:
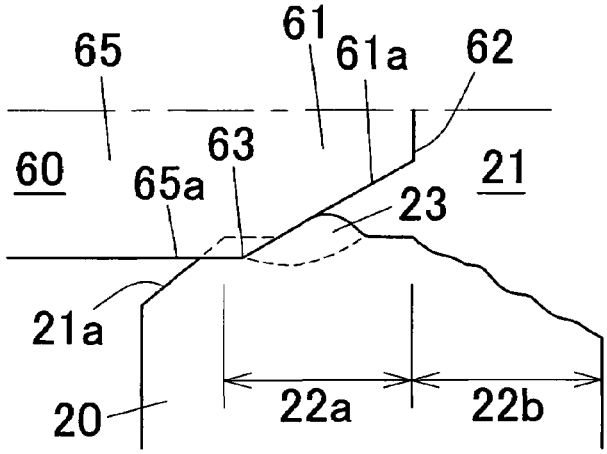
FIGS. 6A to 6C are partially enlarged cross-sectional views each showing the state of the inner periphery of the prepared aperture formed by sizing in the production method of the embodiment.
Figure 6B:
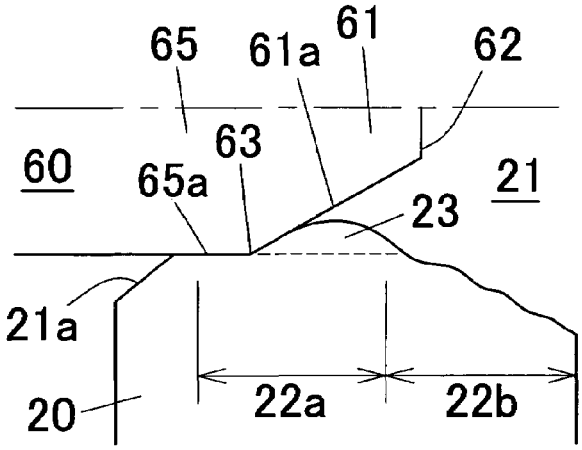
Figure 6C:
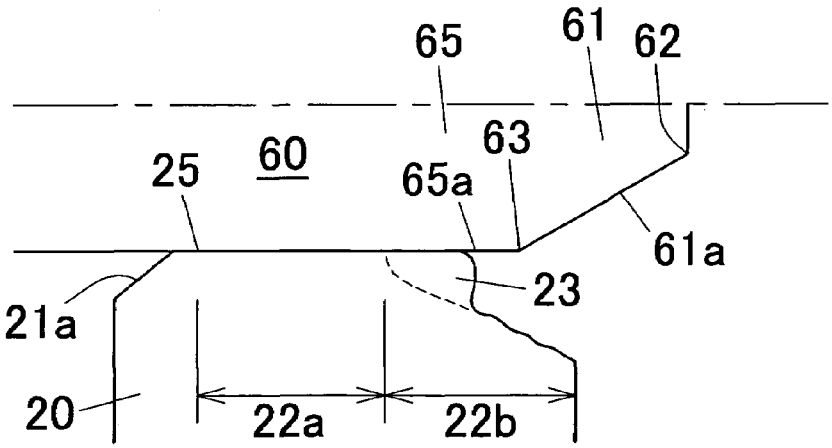

When the aforementioned sizing punch 60 is advanced through the aforementioned prepared aperture 21, as shown in FIG. 6A, the punch 60 is inserted into the prepared aperture 21, so that the portion (material) of the sheared region 22*a* of the inner peripheral portion is pushed forward with the working surface 61*a* of the punch 60. In accordance with the pushing, as shown in FIG. 6B, the portion (inner peripheral portion) of the sheared region 22*a* causes plastic flow, and the plastic flow portion 23 moves to the fractured region 22*b* of the inner peripheral surface of the prepared aperture as shown in FIGS. 6C and 4. Furthermore, when the finishing portion 65 of the punch 60 passes through the prepared aperture 21, the wide portion covering from the one end of the inner peripheral surface of the prepared aperture to the other end thereof will be finished into a smooth surface to thereby form a shaft fixing aperture 25.

By finishing the prepared aperture 21 by the plastic flow of the material forming the inner periphery of the prepared aperture 21, a wide smooth surface is formed in the inner peripheral surface of the shaft fixing aperture 25.

Figure 8:
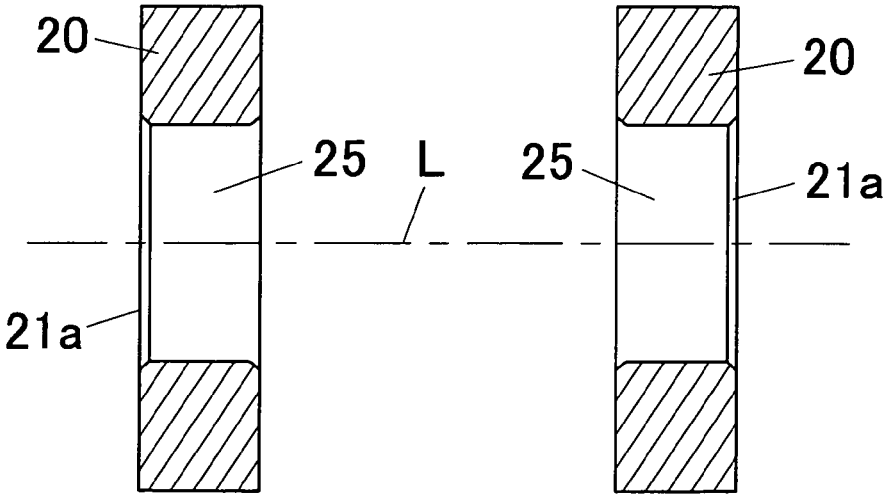
FIG. 8 is a cross-sectional view showing the positional relationship of the prepared apertures after sizing in the production method of the embodiment.

Even in cases where the central axes L of both the prepared apertures 21 and 21 of the bent workpiece 13 do not coincide with each other, i.e., there is a misalignment therebetween, before executing the sizing processing, the insertions of the sizing punches 60 and 60 from both sides will correct the positions of the apertures as shown in FIG. 8. Thus, the shaft fixing apertures 25 and 25 of both side walls 20 and 20 will be disposed with the central axes L aligned correctly.

After completion of the sizing processing, certain processing such as grooving for forming a valve stem contacting groove will be performed. Thus, a rocker arm is manufactured.

With the method for manufacturing a rocker arm according to the embodiment, only press working such as blanking for forming the external configuration and apertures, bending and sizing is employed. Therefore, it is not required to execute machine work such as reaming or cutting which is lower in efficiency as compared with pressing for example, which results in an improved production efficiency and reduced costs.

Furthermore, since the shaft fixing aperture 25 is formed by subjecting the prepared aperture 21 to sizing, a large flat surface can be formed on an inner peripheral surface of the shaft fixing aperture 25. Accordingly, it becomes possible to bring the inner peripheral surface of the aperture 25 into face contact with a supporting shaft, resulting in sufficient shaft holding ability.

Furthermore, in this embodiment, the sizing punch 60 is inserted into the prepared aperture 21 to cause plastic flow of the inner peripheral portion of the prepared aperture to thereby obtain a finished shaft fixing aperture 25. In other words, the inner peripheral surface of the prepared aperture is plastically worked by the working surface 61*a* of the punch 60. Therefore, in contract to a method in which the inner peripheral portion of the prepared aperture is cut with a sharp edge portion such as a shaving punch, no large load would be intensively applied to the working surface 61*a* of the sizing punch 60, which can extend the use-life dramatically. Accordingly, the burden of punch exchanging work can be reduced, the running cost can also be reduced greatly and the burden of maintenance work can also be reduced, resulting in easy maintenance.

Now, with reference to this embodiment, the following explanation will be directed to the correction amount (plastic flow amount) of the prepared aperture 21. The correction amount of the prepared aperture 21 corresponds to the diameter difference between the diameter of the sizing punch 60 and that of the prepared aperture forming punch, and is two times the one side expansion amount X as shown in FIG. 5.

In this embodiment, it is preferable that this one side expansion amount X is 1 to 10%, more preferably 5 to 10%, of the thickness T of the side wall 20 of the rocker arm 10. In cases where this expansion amount is set so as to fall within the aforementioned range, the plastic flow amount of the inner peripheral amount of the aperture can be adjusted appropriately at the time of the sizing processing to form a desired large finished inner peripheral surface. This ensures sufficient shaft holding ability.

In other words, if the expansion amount X is insufficient, the plastic flow amount in the inner peripheral portion of the aperture becomes insufficient. This causes the greater part of the fractured region to be remained, resulting in a failure of large smooth inner peripheral surface in the aperture, which in turn may make it difficult to secure sufficient shaft holding ability. To the contrary, if the expansion amount X is excessive, the plastic flow amount becomes excessive, resulting in a buildup at the inner surface side of the side wall 20 of the rocker arm 10, which may cause such defect that the buildup comes into contact with the roller to be disposed between both side walls 21.

Furthermore, in this embodiment, it is preferable that the angle θ of inclination of the working surface 61*a* of the push enlarging portion 61 with respect to the central angle is set to 10 to 50°, more preferably 12 to 40°, still more preferably 15 to 30°.

When the angle θ of inclination is set so as to fall within the aforementioned range, the plastic flow of the inner peripheral portion can be attained assuredly and smoothly, which makes it possible to attain a desired aperture finishing.

In other words, when the angle θ of inclination is set excessively large, it becomes difficult to attain the plastic flow of the inner peripheral portion assuredly. This may cause shearing or fracturing of the inner peripheral portion, resulting in a failure of desired finishing. When the angle θ of inclination is set excessively small, the axial length of the working surface 61*a* becomes long excessively, which in turn requires a longer punch stroke.

In the manufacturing method of this embodiment, in finishing the shaft fixing aperture 25, the sizing punch 60 is inserted into the prepared aperture 21 to cause the plastic flow of the inner peripheral portion of the aperture. Therefore, in contrast to the case in which the inner peripheral surface of the aperture is shaved by inserting a shaving punch, no chip will generate. Accordingly, after the insertion of the sizing punch 60, it is not required to remove chips in the punch passing aperture 53 of the sizing die 52, enabling elimination of a chip removing step. This further improves the workability.

In the case of press working which requires to remove chips caused by a shaving punch or aperture opening punch from both sides of a work as disclosed in the aforementioned Patent Documents 1 and 2 (JP 3,497,368 B and JP 3,582,977 B), since the press working is low in productivity, it is difficult to improve the production efficiency. In detail, in press working which requires a chip removing step, in order to remove chips remaining in a die, special operations such as relatively moving a punch and a die to open the die aperture and removing chips are inevitable. Such special operations for moving the die for example as mentioned above requires a lot of time, resulting in a long processing time. Accordingly, when pressing works accompanied by special operations are executed subsequent to normal pressing works such as bending pressing or punching pressing, works will be pilled up at the special pressing work. Therefore, it is difficult to execute both the press working uninterruptedly. Under the circumstances, it is hard to form a transfer press machine by combining press working accompanied by special operations and normal press working, which may cause a deterioration of productive efficiency. Furthermore, it also required to employ special structure due to special operations, causing increased costs.

To the contrary, in the manufacturing method of this embodiment, the sizing can be completed by merely inserting the sizing punch 60 into the prepared aperture 21 of the bent workpiece 13, and therefore no chip will generate. As a result, there is no need to remove such chips. Accordingly, in this embodiment, it can be configured only by press working of normal operation which requires no special operation such as die moving operation for removing chips, enabling an employment of a transfer press machine executing all of press working continuously, which in turn can attain automation of a sequence of press working from blanking to finishing. This improves the productivity dramatically. Furthermore, no special operation is required and no special structure for executing special operations is require, which in turn can also reduce production costs.

For reference, in a shaving operation in which punches are inserted from both sides as disclosed in the Patent Documents 1 and 2 mentioned above, the machining ability (working speed) is 10 pieces per minute. To the contrary, in the sizing operation of the embodiment, it is possible to attain the machining ability of about 60 pieces per minute, which is the same machining ability as a normal pressing work not requiring special operations such as a chip removing operation.

Figure 7:
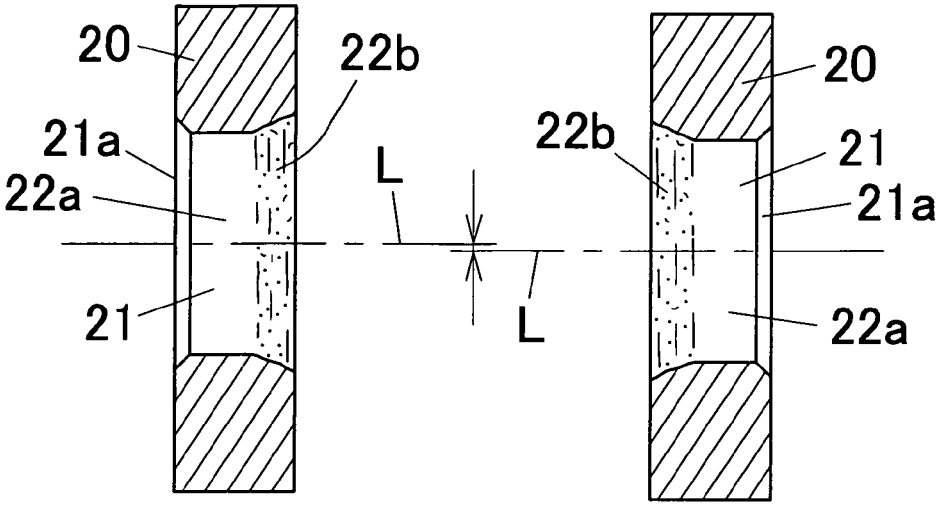
FIG. 7 is a cross-sectional view showing the positional relationship of the prepared apertures before sizing in the production method of the embodiment.

Furthermore, in the sizing operation, both sizing punches 60 and 60 disposed concentrically are simultaneously advanced to finish both the prepared apertures 21 simultaneously. Accordingly, both the finished apertures (shaft fixing apertures 25) can be precisely disposed concentrically, enabling to further improve the quality. Especially like in this embodiment, in cases where a flat blank workpiece 12 is bent after forming the prepared apertures, the central axes L of both the prepared apertures 21 do not always coincide with each other as shown in FIG. 7. Even in cases where there is such positional misalignment, the penetrations of both the sizing punches 60 and 60 from both sides correct the central axes of the apertures simultaneously with the plastic working as shown in FIG. 8. Thus, both the shaft fixing apertures 25 can be coaxially disposed with both the central axes aligned accurately, resulting in high positional accuracy.

Furthermore, in this embodiment, since the pressures for inserting the sizing punches 60 and 60 can be applied evenly in a balanced manner from both sides of the bent workpiece 13, it is possible to assuredly prevent generation of harmful deformation due to the punch inserting pressures, which in turn makes it possible to maintain high quality.

Figure 9A:
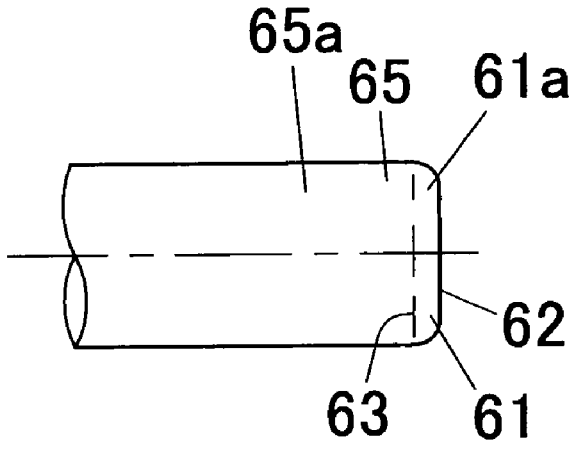
FIG. 9A is a side view showing a sizing punch capable of being employed as a first modified embodiment.

In the aforementioned embodiment, the sizing punch 60 with a working surface 61*a* of a chamfer face (C face) shape flat in cross-section is employed. However, the present invention is not limited to the above, and allows the use of a sizing punch 60 with an R shaped working surface 61*a* circular arc in cross-section as shown in FIG. 9A or a sizing punch with a working surface which is a combination of an R face and a C face.

Figure 9B:
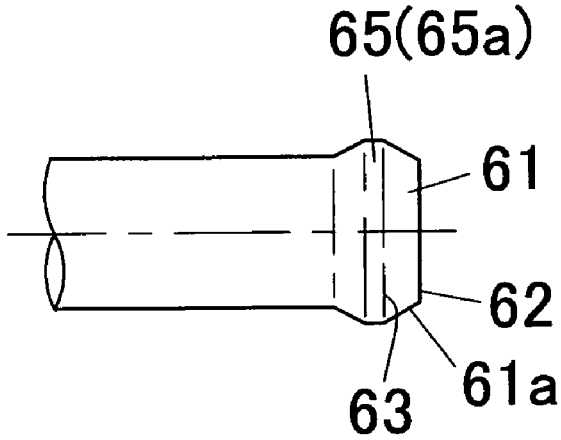
FIG. 9B is a side view showing a sizing punch capable of being employed as a second modified embodiment.
Figure 10:
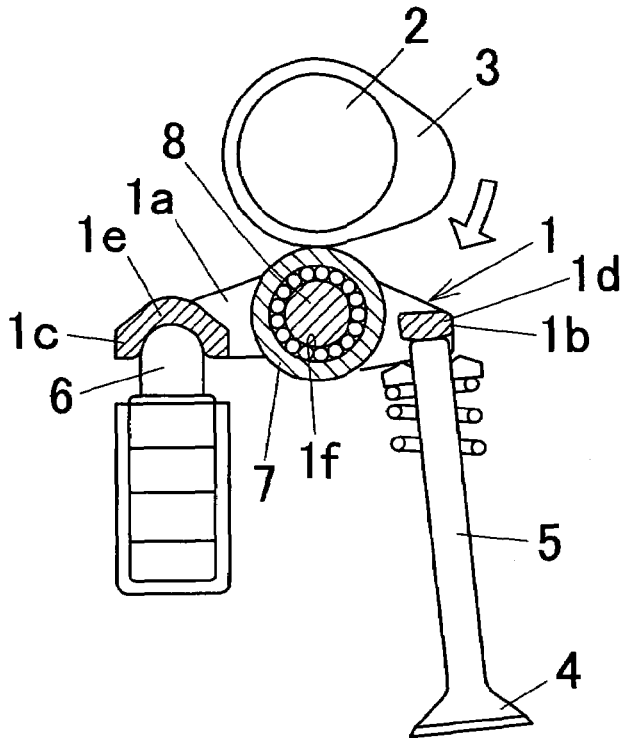
FIG. 10 is a cross-sectional view showing a valve operating system for use in an internal combustion engine for vehicles.
Figure 11A:
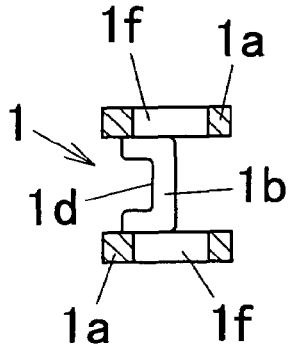
Figure 11B:
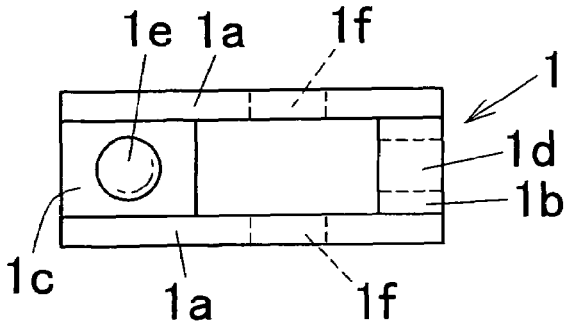

In this invention, for the purpose of decreasing the contact pressure between the punch and the inner peripheral surface of the aperture to be generated when the sizing punch is inserted, a sizing punch 60 having a basal end side portion (rearward side portion) with a diameter smaller than the diameter of the finishing portion 65 as shown in FIG. 9B can be employed.

Furthermore, in the aforementioned embodiment, after forming the prepared aperture 21 in the flat blank workpiece, the blank work piece with the prepared aperture 21 is subjected to bending processing. However, the present invention does not limit to the above. In the present invention, it can be configured such that a blank workpiece with no aperture is subjected to bending processing and thereafter prepared apertures are formed in both the side walls of the bent workpiece. In cases where prepared apertures are to be formed in both side walls of a bent workpiece, it is recommended to employ a punching machine similar to the sizing machine in the aforementioned embodiment. In detail, in place of the sizing punch 60 and the die 52 of the sizing machine shown in FIG. 2, an apparatus provided with aperture opening punches and dies for forming prepared apertures can be used, so that both the punches are simultaneously driven from both sides of the bent workpiece to form prepared apertures in the side walls simultaneously. Furthermore, in such punching machine, it is preferable to use an aperture opening punch with a shoulder portion on the external periphery of the basal end side of the punch so that the shoulder portion can come into contact with the opening edge portion of the prepared aperture simultaneously with the advance movement of the punch to form a chamfer portion.

In cases where prepared apertures are to be simultaneously formed in both side walls of the bent workpiece, as compared to the case in which prepared apertures are formed before the bending processing, both the prepared apertures can be formed coaxially with a high degree of precision. Furthermore, in cases where the aperture opening punches are driven from both sides, the pressures will be given to the bent workpiece equally from both sides. Therefore, it is possible to prevent harmful deformation from being generated by the punching pressures.

EXAMPLES

Example 1

In accordance with the method for manufacturing a rocker arm of the aforementioned embodiment, a bent workpiece 13 with prepared apertures was manufactured. The thickness of the side wall of this bent workpiece 13 was 3.2 mm, and the diameter of the prepared aperture 21 (external diameter of the aperture opening punch) was 8.40 mm. In this bent workpiece 13, among the inner peripheral surface of the prepared aperture 21, the area of 50% along the axis thereof was a sheared region and the remaining area was a fractured region.I Then, as to this bent workpiece 13, the inner peripheral surface of the prepared aperture 13 was finished using a sizing machine 50 similar to that of the aforementioned embodiment to thereby form a shaft fixing aperture 25. At this time, the sizing punch 60 (the external diameter (diameter of shaft fixing aperture) of the finishing portion 65: 8.70 mm, the one side expansion amount with respect to the thickness of the side wall: 9%, and the angle θ of inclination of the external periphery (working surface 61*a*) of the push enlarging portion 61: 46°) was used.

The size of the smooth region of the inner peripheral surface of the shaft fixing aperture of the obtained rocker arm 10 was measured. The results revealed that an 80% of the inner peripheral region along the center of axis was secured as a smooth region.

Example 2

From a bent workpiece 13 with prepared apertures (the wall thickness: 4.0 mm, the prepared aperture diameter: 9.0 mm, the percentage of the sheared region of the inner peripheral surface of the prepared aperture: 40%), a rocker arm was manufactured in the same manner as in Example 1 except that a sizing punch 60 (one side expansion amount: 5%, the angle θ of inclination of the external periphery (working surface 61*a*) of the push enlarging portion 61: 38°) was used.

In this rocker arm, it was confirmed that 75% of the inner peripheral surface area of the shaft fixing aperture was secured as a smooth region.

Example 3

From a bent workpiece 13 with prepared apertures (the wall thickness: 2.3 mm, the prepared aperture diameter: 7.1 mm, the percentage of the sheared region of the inner peripheral surface of the prepared aperture: 50%), a rocker arm was manufactured in the same manner as in Example 1 except that a sizing punch 60 (one side expansion amount: 2%, the angle θ of inclination of the external periphery (working surface 61*a*) of the push enlarging portion 61: 30°) was used.

In this rocker arm, it was confirmed that 70% of the inner peripheral surface area of the shaft fixing aperture was secured as a smooth region.

The present invention can be used to manufacture a rocker arm for opening and closing a valve in a valve operating system for use in an internal combustion engine for vehicles for example.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

What is claimed is:

1. A method for manufacturing a rocker arm, comprising the steps of:

obtaining a bent workpiece with prepared apertures, wherein the bent work piece includes a pair of side walls disposed in parallel with each other, and connecting walls for connecting the side walls, the pair of side walls each having a prepared aperture formed by driving an aperture forming punch into each side wall; and forming a roller supporting shaft fixing aperture by inserting sizing punches respectively into each prepared aperture, wherein each sizing punch has a tapered push enlarging portion at a tip end portion, a basal end side of the push enlarging portion being larger than each prepared aperture in diameter, and a tip end side of the push enlarging portion being smaller than each prepared aperture in diameter, whereby the push enlarging portion causes plastic flow of an inner peripheral portion of each prepared aperture in a sheared region of each prepared aperture so that the plastically flowed portion moves to an inner peripheral surface of each prepared aperture in a fractured region of each prepared aperture to finish the inner peripheral surface of each prepared aperture to thereby obtain roller supporting shaft fixing apertures, whereby the tapered push enlarging portion of each sizing punch respectively passes completely through each prepared aperture to form a finished smooth surface on the inner peripheral surface of each prepared aperture.

2. The method for manufacturing a rocker arm as recited in claim 1, wherein an external peripheral surface of the push enlarging portion of each sizing punch is formed as a tapered working surface, and wherein an angle of inclination of the working surface with respect to an axis of each sizing punch is set to 10 to 50 degrees.

3. A method for manufacturing a rocker arm, comprising the steps of:

obtaining a flat workpiece with prepared apertures to be formed into roller supporting shaft fixing apertures, the prepared apertures formed by driving an aperture forming punch into the flat workpiece;

obtaining a bent workpiece with prepared apertures by bending the flat workpiece with prepared apertures, the bent work piece including a pair of side walls disposed in parallel with each other, and connecting walls for connecting the side walls, the pair of side walls each having a prepared aperture; and forming a roller supporting shaft fixing aperture by inserting sizing punches respectively into each prepared aperture, wherein each sizing punch has a tapered push enlarging portion at a tip end portion, a basal end side of the push enlarging portion being larger than each prepared aperture in diameter, and a tip end side of the push enlarging portion being smaller than each prepared aperture in diameter, whereby the push enlarging portion causes plastic flow of an inner peripheral portion of each prepared aperture in a sheared region of each prepared aperture so that the plastically flowed portion moves to an inner peripheral surface of each prepared aperture in a fractured region of each prepared aperture to finish the inner peripheral surface of each prepared aperture to thereby obtain roller supporting shaft fixing apertures, whereby the tapered push enlarging portion of each sizing punch passes completely through each prepared aperture to form a finished smooth surface on the inner peripheral surface of each prepared aperture.

4. The method for manufacturing a rocker arm as recited in claim 3, wherein the step of forming the roller supporting shaft fixing apertures includes:

disposing the sizing punches at opposite side walls of the bent workpiece such that the sizing punches oppose each other and are aligned with the prepared apertures;

and simultaneously inserting both sizing punches into the prepared apertures of the side walls to simultaneously finish the prepared apertures.

* * * * *